US008051746B2

(12) United States Patent
Bouchard et al.

(10) Patent No.: US 8,051,746 B2
(45) Date of Patent: Nov. 8, 2011

(54) RATCHET WRENCH WITH COLLAR-ACTUATED REVERSING MECHANISM

(75) Inventors: James Francis Bouchard, Bethlehem, PA (US); Douglas Edward Souls, Andover, NJ (US); Jefferey Clifford Yaschur, Doylestown, PA (US)

(73) Assignee: Ingersoll Rand Company, Montvale, NJ (US)

( * ) Notice: Subject to any disclaimer, the term of this patent is extended or adjusted under 35 U.S.C. 154(b) by 196 days.

(21) Appl. No.: 12/494,679

(22) Filed: Jun. 30, 2009

(65) Prior Publication Data

US 2010/0326243 A1 Dec. 30, 2010

(51) Int. Cl.
*B25B 13/46* (2006.01)

(52) U.S. Cl. ..... 81/57.39; 81/63

(58) Field of Classification Search ..... 81/57.39, 81/62, 57.14, 63, 57.3, 63.1, 57.13, 57.29, 81/63.2

See application file for complete search history.

(56) References Cited

U.S. PATENT DOCUMENTS 585,533 A * 6/1897 Quin ..... 81/62
1,164,764 A 12/1915 Skjervem
1,913,669 A 6/1933 Heald
3,529,498 A 9/1970 Northcutt
4,218,940 A * 8/1980 Main ..... 81/63
4,245,528 A 1/1981 Hugh et al.
4,300,413 A 11/1981 Garofalo
4,406,183 A 9/1983 Wix
4,445,404 A 5/1984 Parker
4,480,510 A 11/1984 Aparicio, Jr. et al.
4,566,356 A * 1/1986 Herota ..... 81/62
4,766,784 A 8/1988 Lai
4,919,022 A 4/1990 Ono et al.
RE33,711 E 10/1991 Ono et al.
5,230,262 A * 7/1993 Ahlund et al. ..... 81/63.2
5,237,885 A 8/1993 Putney et al.

(Continued)

FOREIGN PATENT DOCUMENTS

DE 102006040005 A1 3/2007

OTHER PUBLICATIONS

Ingersoll Rand, photos of tools, Ingersoll Rand—107, Matco—1848, Snap on-FAR7200, Mac-AR154, Chicago Pneumatic—828, at least as early as Nov. 6, 2007.

(Continued)

*Primary Examiner* — Hadi Shakeri
(74) *Attorney, Agent, or Firm* — Michael Best & Friedrich LLP

(57) ABSTRACT

A ratchet wrench has a handle and a ratchet housing that both extend along a first axis. A drive body is connected for rotation relative to the ratchet housing about a second axis, perpendicular to the first axis. A yoke substantially encircles the body and is connected to the ratchet housing and a direction selector is coupled to the drive body and extends along the second axis. The direction selector is rotatable about the second axis with respect to the drive body between a first position, in which the yoke is fixed for counterclockwise rotation with the drive body about the second axis, and a second position, in which the yoke is fixed for clockwise rotation with the drive body about the second axis. A direction actuator is connected to the direction selector for rotation about the first axis to move the direction selector between the first and second positions.

18 Claims, 6 Drawing Sheets

U.S. PATENT DOCUMENTS

| | | | | |
|---|---|---|---|---|
| 5,251,706 | A | 10/1993 | Evans | |
| 5,309,796 | A | 5/1994 | Jones | |
| 5,535,646 | A | 7/1996 | Allen et al. | |
| 5,582,080 | A | 12/1996 | Barmore | |
| 5,622,089 | A | 4/1997 | Gifford, Sr. | |
| 5,636,698 | A | 6/1997 | Estep et al. | |
| 5,896,789 | A | 4/1999 | Giardino | |
| 6,093,128 | A | 7/2000 | Seith | |
| D440,848 | S | 4/2001 | Izumisawa | |
| 6,253,647 | B1 * | 7/2001 | Eggert et al. | 81/63 |
| 6,282,990 | B1 | 9/2001 | Miner | |
| D449,212 | S | 10/2001 | Price et al. | |
| 6,311,583 | B1 | 11/2001 | Izumisawa | |
| 6,481,316 | B1 * | 11/2002 | Liao | 81/63 |
| 6,490,953 | B2 | 12/2002 | Horvath | |
| D468,607 | S | 1/2003 | Price et al. | |
| 6,578,643 | B2 | 6/2003 | Izumisawa | |
| 6,640,669 | B2 * | 11/2003 | Izumisawa | 81/57.39 |
| D496,568 | S | 9/2004 | Izumisawa | |
| 6,789,448 | B2 | 9/2004 | Ono et al. | |
| 6,860,174 | B2 | 3/2005 | Kusama | |
| 6,915,721 | B2 | 7/2005 | Hsu et al. | |
| 6,923,095 | B2 | 8/2005 | Horvath | |
| 7,059,217 | B2 | 6/2006 | Horvath | |
| D527,593 | S | 9/2006 | Price et al. | |
| 7,121,167 | B1 | 10/2006 | Miner | |
| D554,460 | S | 11/2007 | Enriquez | |
| D576,460 | S | 9/2008 | Price et al. | |
| D578,852 | S | 10/2008 | Enriquez | |
| 2005/0211026 | A1 | 9/2005 | Cheng | |
| 2006/0060032 | A1 | 3/2006 | Baker | |
| 2007/0068346 | A1 * | 3/2007 | Izumisawa | 81/57.39 |

OTHER PUBLICATIONS

International Search Report for Application No. PCT/US2010/040549, dated Nov. 24, 2010 (4 pages).

Written Opinion for Application No. PCT/US2010/040549, dated Nov. 24, 2010 (6 pages).

* cited by examiner

RATCHET WRENCH WITH COLLAR-ACTUATED REVERSING MECHANISM

BACKGROUND

The present invention relates to ratchet wrenches that are drivable both clockwise and counterclockwise and a reversing mechanism for selecting the direction of operation.

SUMMARY

In one embodiment, the invention provides a ratchet wrench having an elongate handle that has a first end and second free end, and extends substantially along a first axis. A ratchet housing has a first free end and a second end connected to the handle first end, extends substantially along the first axis, and has a first portion and a second portion spaced from the first portion, such that the first and second portions extend substantially along the first axis. A drive body is connected to the ratchet housing for rotation relative to the ratchet housing about a second axis, that is substantially perpendicular to the first axis, and the drive body extends between the first and second portions of the ratchet housing. A yoke is connected to the ratchet housing for oscillating movement with respect to the ratchet housing. The yoke substantially encircles the drive body. A direction selector is coupled to the drive body and extends along the second axis. The direction selector is rotatable about the second axis with respect to the drive body between a first position, in which the yoke is rotatable clockwise with respect to the drive body and the yoke is coupled to the drive body for counterclockwise rotation with the drive body about the second axis, and a second position, in which the yoke is rotatable counterclockwise with respect to the drive body and the yoke is coupled to the drive body for clockwise rotation with the drive body about the second axis. A direction actuator is connected to the direction selector for rotation about the first axis to move the direction selector between the first and second positions.

In another embodiment, the invention provides a ratchet wrench including an elongate handle having a first end and second free end, and extending substantially along a first axis. A ratchet housing having a first free end and a second end coupled to the handle first end and extending substantially along the first axis. The ratchet housing has a first portion that extends substantially parallel to the first axis and defines a first aperture, and a second portion spaced from the first portion and that extends substantially parallel to the first axis and defines a second aperture. A drive body is connected to the ratchet housing proximate the ratchet housing first end. The drive body is operable to rotate relative to the ratchet housing about a second axis, substantially perpendicular to the first axis. The drive body includes a body portion extending between the first and second portions, and a projection extending through the second aperture. A yoke is connected to the ratchet housing for movement with respect to the ratchet housing. The yoke is positioned to selectively engage the drive body. A direction selector is connected to the drive body, extends along the second axis and extends into the first aperture. The direction selector is rotatable relative to the drive body about the second axis between a first position and a second position. When in the first position, the yoke is rotatable clockwise with respect to the drive body and the yoke is coupled to the drive body for counterclockwise rotation with the drive body about the second axis. When in the second position, the yoke is rotatable counterclockwise with respect to the drive body and the yoke is coupled to the drive body for clockwise rotation with the drive body about the second axis. A direction actuator is coupled to the ratchet housing for rotation about the first axis. The direction actuator is spaced from the drive body along the first axis, and connected to the direction selector to rotate the direction selector about the second axis between the first and second positions.

In another embodiment, the invention provides a ratchet wrench including an elongate handle extending substantially along a first axis. A ratchet housing is connected to the handle and the ratchet housing extends substantially along the first axis. The ratchet housing has a first portion that extends substantially parallel to the first axis and defines a first aperture, and a second portion spaced from the first portion and that extends substantially parallel to the first axis and defines a second aperture. A drive body is connected to the ratchet housing for rotation relative to the ratchet housing about a second axis, substantially perpendicular to the first axis. The drive body includes a body portion that defines a third aperture that extends along the second axis between the first and second apertures, and a protruding portion that extends through the second aperture. A yoke is connected to the ratchet housing for movement with respect to the ratchet housing. The yoke includes a yoke aperture that receives a portion of the drive body therethrough. A direction selector has a shaft portion and a gear portion. The shaft portion extends through the first aperture and into the third aperture of the drive body. The gear portion has at least one tooth and positioned outside the first aperture and spaced from the second portion. The direction selector is rotatable between a first position, in which the yoke is rotatable clockwise with respect to the drive body and the yoke is coupled to the drive body for counterclockwise rotation with the drive body about the second axis, and a second position, in which the yoke is rotatable counterclockwise with respect to the drive body and the yoke is coupled to the drive body for clockwise rotation with the drive body about the second axis. A direction actuator assembly includes a right angle gear that has intermittent teeth and a collar that is connected to the ratchet housing, such that the right angle gear and the collar are rotatable with respect to the ratchet housing about the first axis. At least one spur gear has a plurality of teeth and is positioned to engage the at least one tooth of the gear portion and the intermittent teeth of the right angle gear. Rotation of the direction actuator assembly about the first axis rotates the direction selector about the second axis to move the direction selector between the first and second positions.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
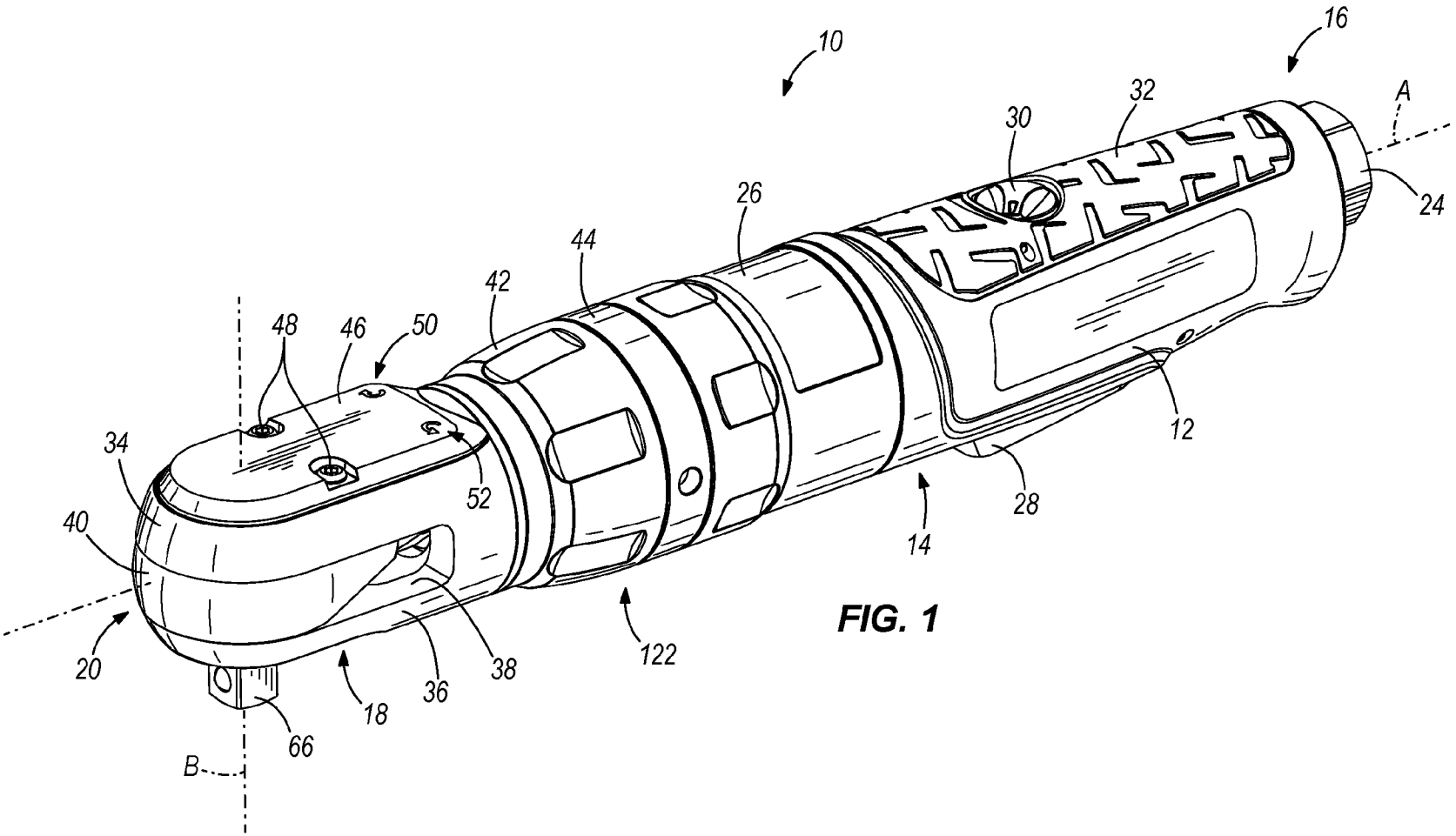
FIG. 1 is a perspective view of a ratchet wrench having a collar-actuated reverse mechanism.

FIG. 1 shows a power ratchet wrench 10 having an elongate handle 12 having a first end 14 and a second free end 16 and a ratchet housing 18 having a first free end 20 and a second end 22 (see FIG. 3) that is received in the handle first end 14. The elongate handle 12 extends along a first axis A. The illustrated ratchet wrench 10 includes an inlet bushing assembly 24 at the second free end 16, an exhaust deflector 26 positioned at the first end 14, a trigger 28 and a regulator 30 to adjust the flow of fluid through the power ratchet wrench 10. The illustrated power ratchet operates under the influence of motive fluid (e.g. compressed air) supplied through the inlet bushing assembly 24. In another configuration, the invention may be embodied in an electric ratchet wrench. Alternatively, the invention may be embodied in a hand-powered ratchet wrench that does not include the inlet bushing assembly 24, the exhaust deflector 26, the trigger 28 or the regulator 30, and that operates under the influence of manual torque applied to handle 12 about axis B. The illustrated handle 12 includes a textured grip portion 32 to assist an operator in gripping the handle 12.

Figure 2:
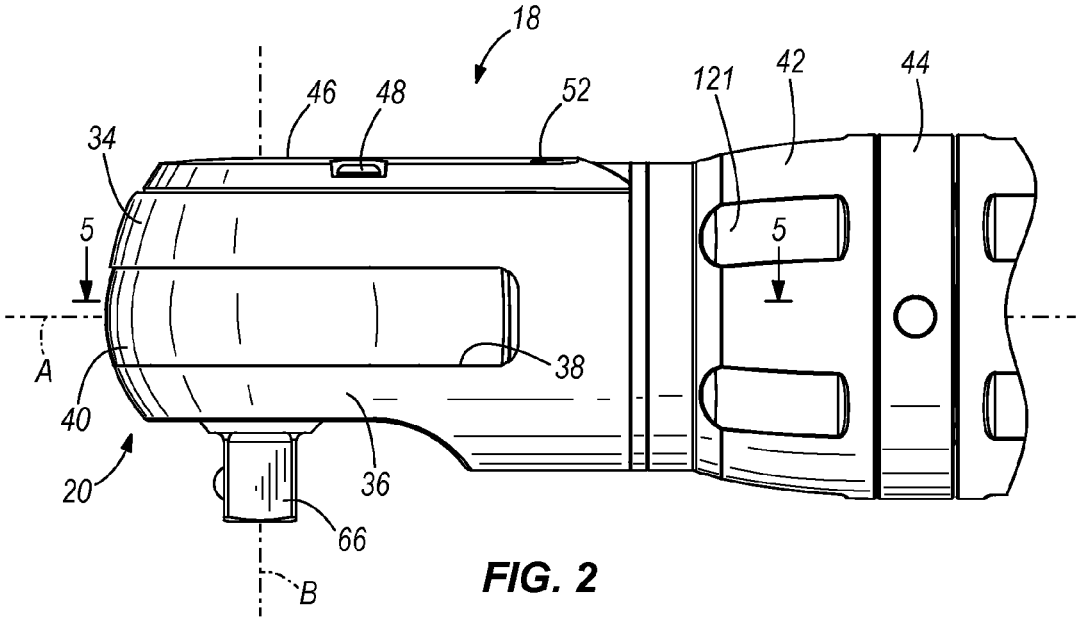
FIG. 2 is a side view of a head portion of the ratchet wrench of FIG. 1.

FIGS. 1 and 2 illustrate the ratchet housing 18 having a first portion, such as first ear 34, extending substantially parallel to the first axis A and a second portion, such as second ear 36, spaced from the first ear 34 and extending substantially parallel to the first axis A. The first ear 34 and second ear 36 define parallel surfaces that define a slot 38 therebetween. A yoke 40 is inserted into the slot 38 between the first and second ears 34, 36. A collar 42 is positioned around the ratchet housing second end 22. A coupling nut 44 is inserted onto the ratchet housing second end 22 to retain the collar 42 on the ratchet housing second end 22. The collar 42 is rotatable about first axis A to change the direction of rotation of the ratchet wrench. A cover plate 46 is coupled to the first ear 34 with a plurality of fasteners, such as the illustrated screws 48. The cover plate 46 is substantially flat or planar, such that the ratchet wrench 10 can be inserted into tight areas. The cover plate 46 can include indicating arrows, such as clockwise arrow 50 and counterclockwise arrow 52. Other suitable indicia can be utilized to indicate the operating direction of the ratchet wrench.

Figure 3:
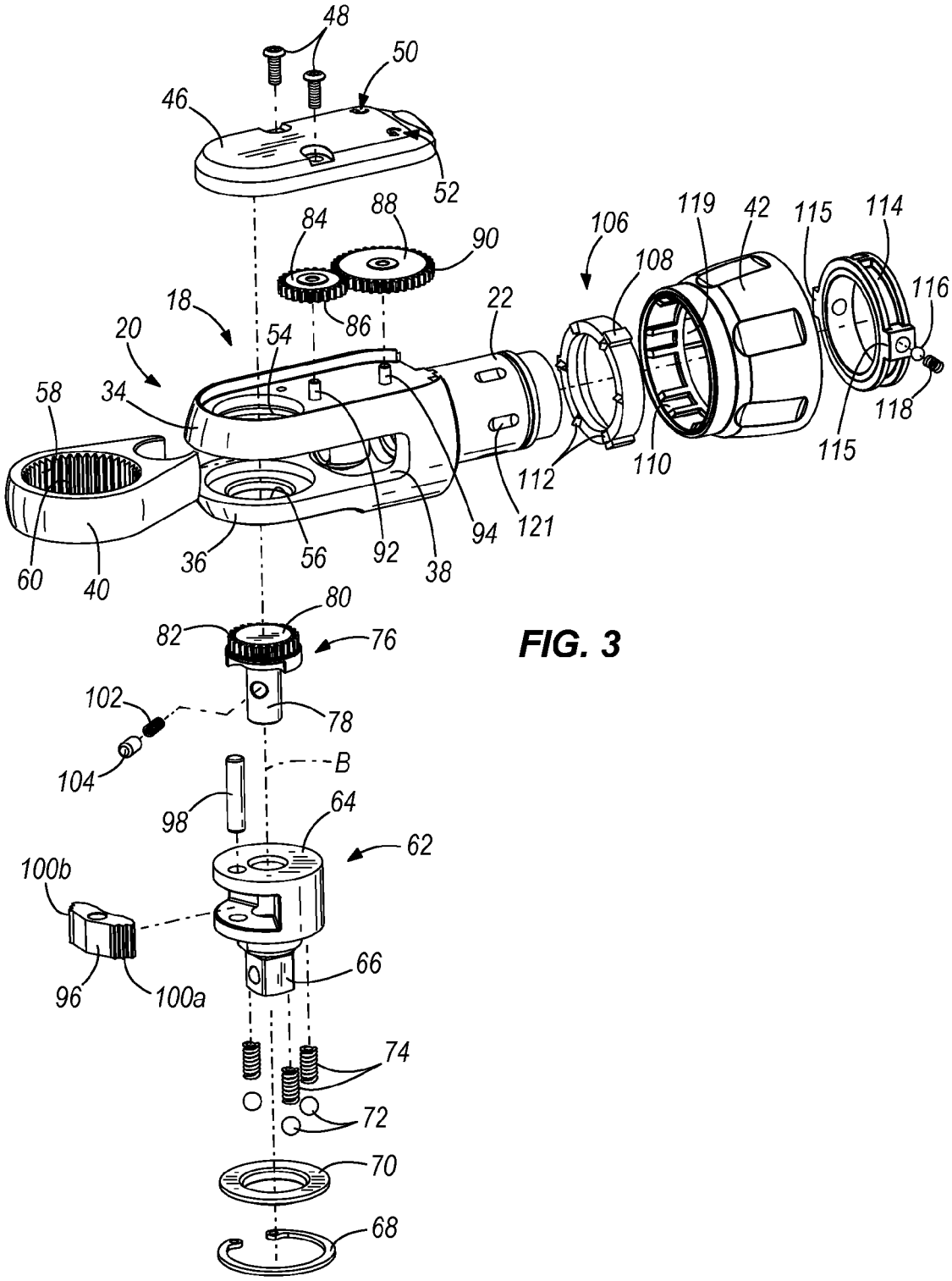
FIG. 3 is an exploded view of the head portion shown in FIG. 2.

FIG. 3 shows the cover plate 46 and screws 48 exploded off of the first ear 34 to reveal a first aperture 54 defined by the first ear 34. The second ear 36 defines a second aperture 56 that is substantially aligned with the first aperture 54. The yoke 40 defines a third aperture 58 that is substantially aligned with the first and second apertures 54, 56 when the yoke 40 is inserted between the first and second ears 34, 36. The illustrated third aperture 58 defines a plurality of teeth 60 that extend inward.

A drive body 62 includes a body portion 64 and a projection 66. The body portion 64 is positioned in the third aperture 58 and the projection 66 extends through the second aperture 56. The drive body 62 is retained in the third aperture 58 by a retaining ring 68, a thrust washer 70, a plurality of balls 72 and a plurality of springs 74. The drive body 62 receives a direction selector 76 that is rotatable within the drive body 62 about the second axis B. The direction selector 76 includes a shaft portion 78 and a gear portion 80. The shaft portion 78 extends into the drive body 62 and the gear portion 80 extends out of the drive body 62 and into the first aperture 54. The gear portion 80 includes a plurality of teeth 82.

Figure 4:
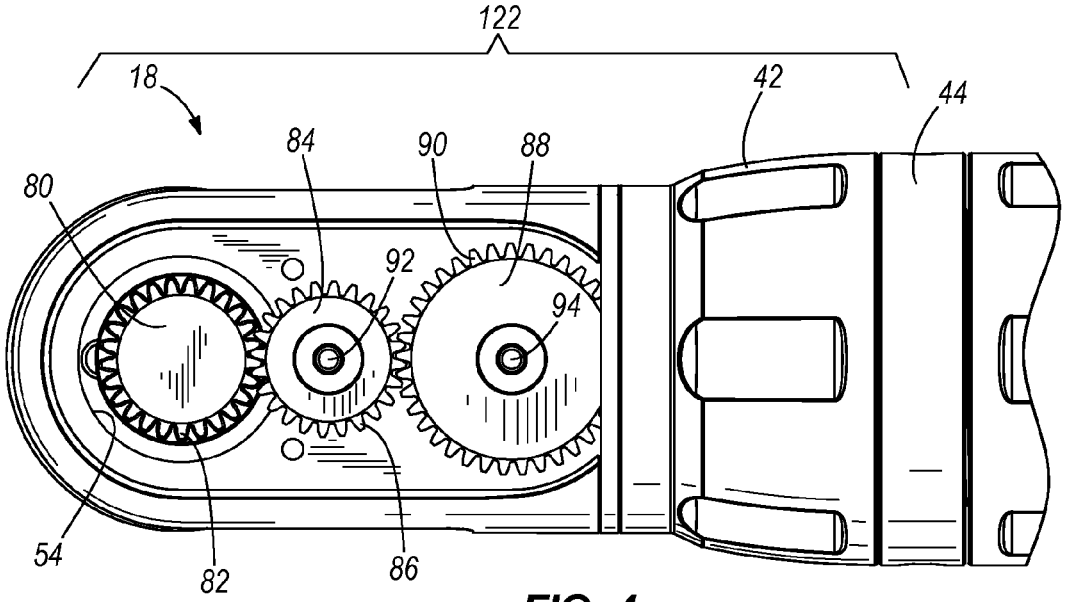
FIG. 4 is a top view of the head portion shown in FIGS. 2 and 3 with a top plate removed to reveal a plurality of gears.

As shown in FIGS. 3 and 4, the ratchet wrench 10 includes a first gear 84 having a plurality of teeth 86 and a second gear 88 having a plurality of teeth 90. The first and second gears 84, 88 are coupled to respective pins 92, 94 protruding from the first ear 34. The first and second gears 84, 88 are rotatable about the respective pins 92, 94. The first and second gears 84, 88 are rotatable about axes that are substantially parallel to the second axis B. The teeth 86 of the first gear 84 mesh with the teeth 82 of the gear portion 80, and with the teeth 90 of the second gear 88. The gear portion 80, the first gear 84 and the second gear 88 together form a gear train. Rotation of one of the gears 80, 84, 88 causes rotation of the other of the gears 80, 84, 88.

Figure 5:
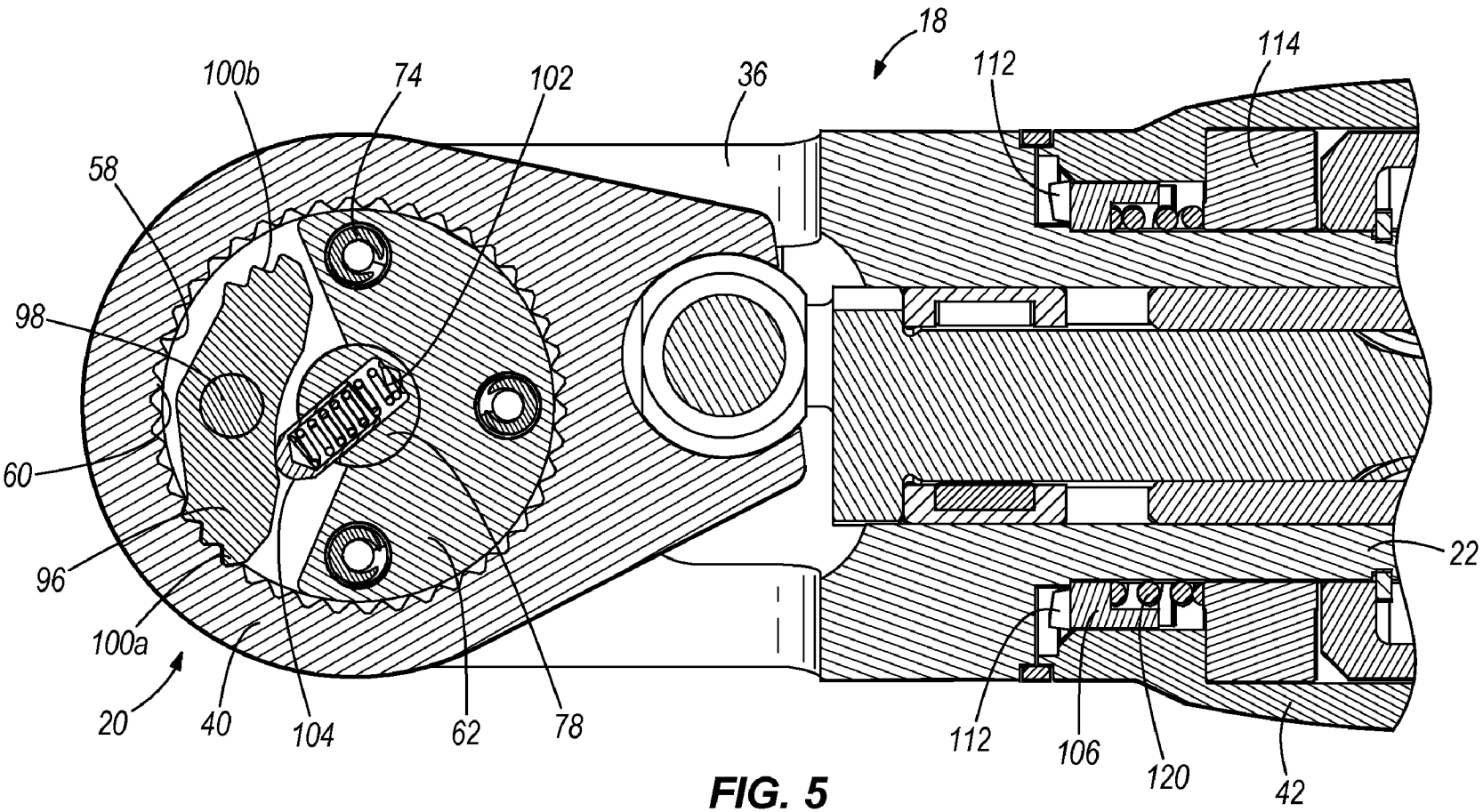
FIG. 5 is a cross-sectional view of the head portion taken along line 5-5 of FIG. 2.

The ratchet wrench 10 further includes a double-sided pawl 96 coupled to the drive body 62 by a pin 98. The pawl 96 includes a first set of teeth 100*a* and a second set of teeth 100*b*, spaced from the first set of teeth 100*a*. The pawl 96 is rotatable about the pin 98, such that one set of teeth 100*a* or 100*b* engages the yoke teeth 60 and the other set of teeth 100*a* or 100*b* is spaced from the yoke teeth 60. In FIG. 5, the first set of teeth 100*a* is engaged with the yoke teeth 60. A spring 102 and a pin 104 are inserted into the shaft portion 78 of the direction selector 76 to bear against the pawl 96 to bias one set of pawl teeth 100*a* or 100*b* against the yoke teeth 60. When the direction selector 76 is rotated about the second axis B, the pin 104 moves along the pawl 96 to rotate the pawl 96 about the pin 98. More specifically, the biasing force of the pin 104 and spring 102 toggle the pawl 96 to engage teeth 100*a* or 100*b* on the yoke 40 as the line of force crosses the pivot axis of the pawl (i.e. the axis of the pin 98, which is parallel to axis B).

With continued reference to FIGS. 3 and 5, the ratchet wrench 10 further includes a right angle gear 106 positioned on the second end 22 of the ratchet housing 18. The right angle gear 106 includes a plurality of protrusions 108 extending radially (with respect to axis A) outward to substantially mate with recesses or channels 110 in the collar 42. The illustrated embodiment includes three protrusions 108 and six channels 110. In another embodiment, three protrusions and three channels are provided. Other quantities and arrangements of protrusions and channels are possible and the illustrated embodiment is given by way of example only and is not intended to limit the scope of the present invention. The right angle gear 106 is substantially positioned within the collar 42 and is fixed for rotation with the collar 42 about the first axis A due to the engagement of the protrusions 108 in the channels 110. The right angle gear 106 further includes intermittent axially extending (with respect to axis A) teeth 112 that selectively engage the teeth 90 to rotate the second gear 88 and thereby rotate first gear 84, gear portion 80 and pawl 96. Rotation of the right angle gear 106 about first axis A causes the ratchet wrench 10 to switch between clockwise and counterclockwise rotation about the second axis B, which is substantially perpendicular to the first axis A. In the illustrated embodiment, there are six intermittent teeth 112, but other quantities and spacing between the intermittent teeth 112 are possible, depending upon the geometry of the ratchet wrench and relative gear ratios.

The ratchet wrench 10 further includes a detent holder 114 positioned within the collar 42. The detent holder 114 includes a pair of protrusions 115, and each protrusion 115 retains a detent ball 116 and a detent spring 118 against the collar 42. The collar 42 includes a pair of channels 119 that matingly receive the respective protrusions 115 to fix the detent holder 114 to the collar 42 for rotation with the collar 42. A plurality of detents 121 are defined in the ratchet housing second end 22 to receive the detent ball 116 to resist movement of the collar 42 from a first position or a second position. A detent mechanism includes the detent holder 114, the balls 116, the springs 118, and detents 121. Other shapes and sizes of detents 121, detent balls 116 and detent springs 118 can be utilized. In some embodiments, at least one of the detents 121, detent balls 116 and detent springs 118 is omitted.

When the collar 42 is in the first position, the drive body 62 rotates clockwise about the second axis B to rotate a fastener clockwise about the second axis B. When the collar 42 is in the second position, the drive body 62 rotates counterclockwise about the second axis B to rotate a fastener counterclockwise about the second axis B.

The gear portion 80, the first gear 84 and the second gear 88 together form a drive train 122. The collar 42, the right angle gear 106, the drive train 122, the direction selector 76, the spring 102, the pin 104 and the pawl 96 together form a direction actuator assembly. Rotation of the direction actuator assembly rotates the direction selector 76 through the drive train 122, pivots the pawl 96 about the pin 98 and thereby moves teeth 100*a* or teeth 100*b* into engagement with the yoke teeth 60.

Figures 6, 7, 8:
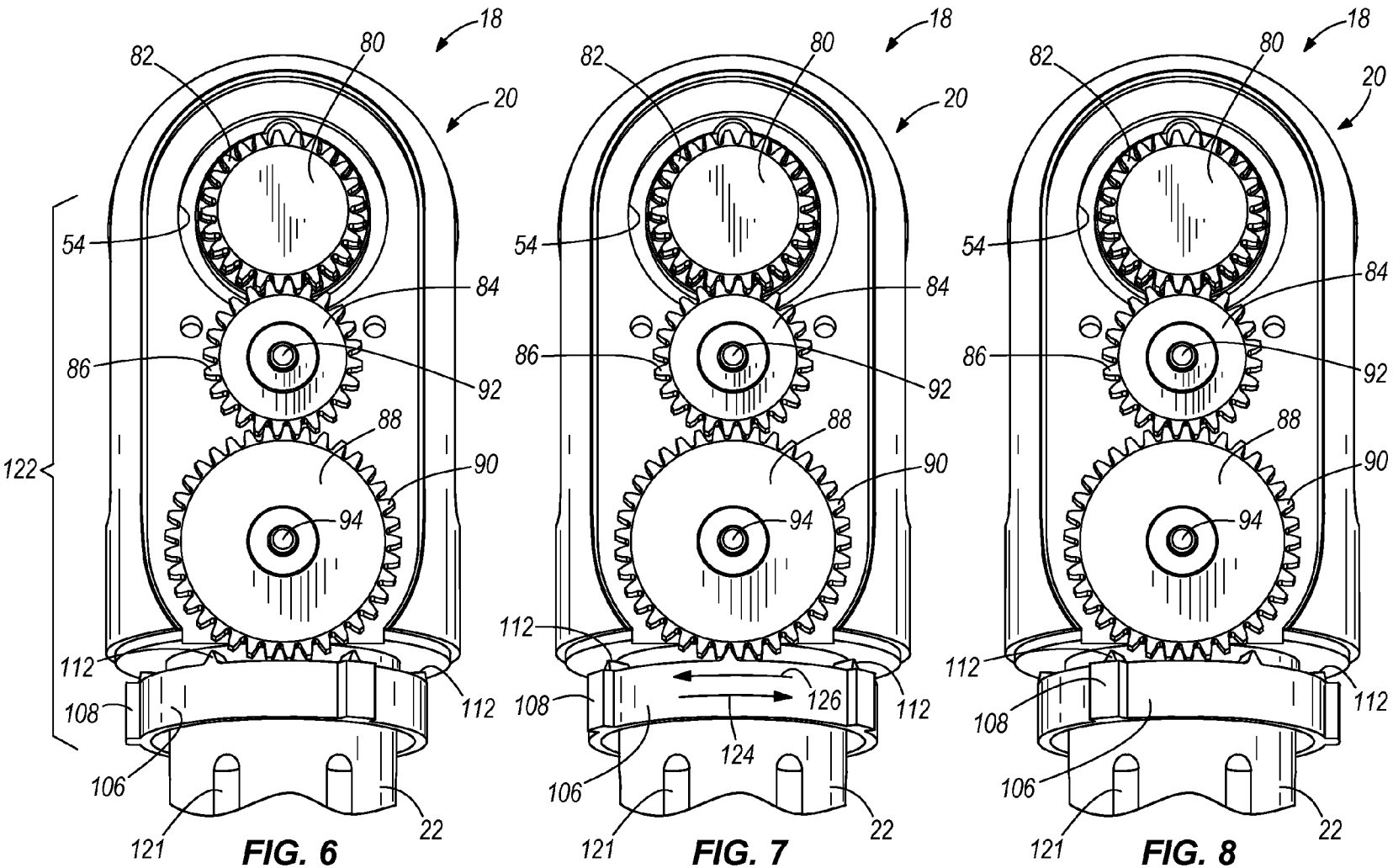
FIG. 6 is a top view of the head portion with the top plate removed and including a plurality of gears in a first position.
FIG. 7 is a top view of the head portion of FIG. 6 with the gears in transition between the first position and a second position.
FIG. 8 is a top view of the head portion of FIGS. 6 and 7 with the gears in the second position.

The operation of the ratchet wrench 10 is illustrated in FIGS. 6-8. FIG. 6 illustrates the ratchet wrench 10 in the first position, in which the pawl teeth 100*b* are engaging the yoke teeth 60, to permit the yoke 40 to rotate clockwise with respect to the drive body 62 about the second axis B, and lock the yoke 40 and drive body 62 together for counterclockwise rotation about second axis B, as viewed in FIGS. 5-8. The detent mechanism resists movement of the right angle gear 106 out of the first position, but can be overcome by an operator rotating the collar 42 to overcome the biasing force of the springs 118 and cause the balls to ride out of the detents 121.

FIG. 7 shows the right angle gear 106 in transition between the first position and the second position. Rotation of the right angle gear 106 in the direction of arrow 124 causes the drive train 122 and pawl 96 to move from the first position to the second position. Rotation of the right angle gear 106 in the direction of arrow 126 causes the drive train 122 and the pawl 96 to move from the second position to the first position. This rotation causes one or more of the intermittent teeth 112 to engage the second gear teeth 90 to rotate the second gear 88, and thereby rotate the first gear 84 and the direction selector 76. Rotation of the direction selector 76 causes the pawl 96 to pivot about the pin 98. A spring 120 (FIG. 5) can be positioned between the detent holder 114 and the right angle gear 106 to retain the right angle gear 106 in engagement with the second gear 88.

FIGS. 5 and 8 show the ratchet wrench in the second position, in which the pawl teeth 100*a* are engaging the yoke teeth 60, to permit the yoke 40 to rotate counterclockwise with respect to the drive body 62 about the second axis B, and lock the yoke 40 and the drive body 62 together for clockwise rotation about second axis B, as viewed in FIGS. 5-8. The detent mechanism resists movement of the right angle gear 106 out of the second position, but can be overcome by an operator rotating the collar 42 to overcome the biasing force of the springs 118 and cause the balls to ride out of the detents 121.

In the illustrated embodiment, the gears 80, 84, 88 are all spur gears, but other gear shapes and configurations are possible. Even though three gears 80, 84 and 88 are illustrated, different quantities and sizes of gears are envisioned. In embodiments that include gears 80 and 84 and omit gear 88, the right angle gear 106 is rotated in the direction of arrow 124 to rotate the drive body 62, the projection 66 and a fastener counterclockwise, as viewed in FIGS. 5-8. In the illustrated embodiment, the right angle gear 106 is rotated clockwise or in the direction of arrow 124 to rotate the drive body 62, the projection 66 and a fastener clockwise, as viewed in FIGS. 5-8. Other configurations and arrangements of gears can be utilized in accordance with the present invention.

In the illustrated embodiment, the right angle gear 106 is a face gear with intermittent teeth 112 that project outward, parallel to the first axis A, to engage the gear teeth 90. In another embodiment, the right angle gear is a bevel gear with intermittent teeth that engage a secondary profile on the rearmost gear, such as mating bevel teeth. In still another embodiment, the right angle gear is replaced with a third spur gear that has intermittent teeth to engage a continuous right angle gear profile on the rearmost spur gear. Other variations of gear and gear train arrangements are possible and these are given by way of example only and are not intended to limit the scope of the present invention.

An operator can change rotational direction of the drive body 62 and hold the handle 12 with the same hand. For example, the operator can hold the trigger 28 with one finger and rotate the direction actuator assembly with the thumb of the same hand. The direction actuator assembly rotates about the first axis A to alter the rotational direction of the drive body 62 about the second axis B, which is substantially perpendicular to the first axis A. The direction actuator assembly is positioned proximate the handle 12 and rotates about the first axis A that is defined by the handle 12. Because the direction actuator assembly is spaced from the drive body 62 and the cover plate 46 is substantially flat, the rotational direction of the ratchet wrench 10 can be changed when the ratchet wrench 10 is inserted into tight or confined areas.

Figure 9:
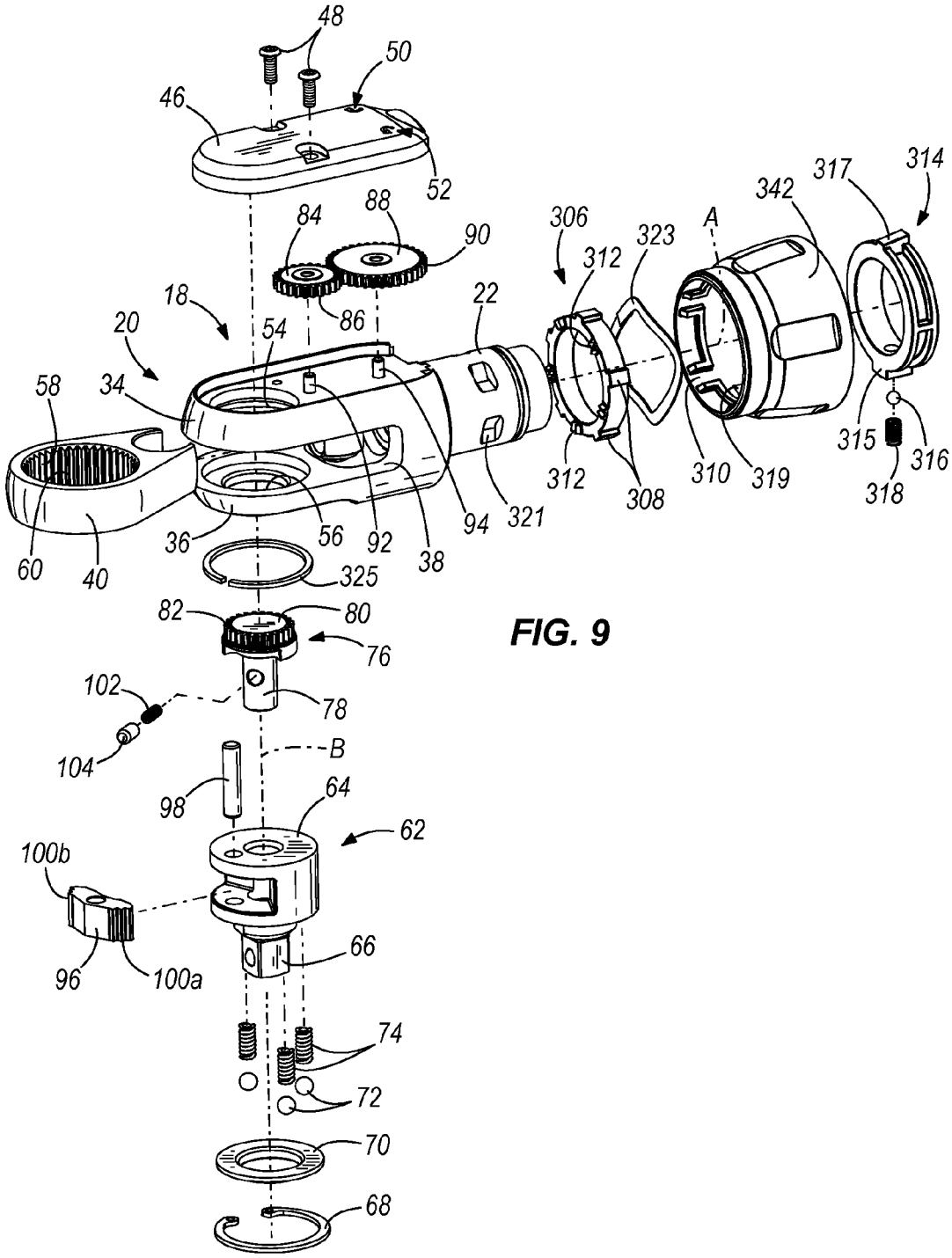
FIG. 9 is an exploded view of an alternative embodiment of a ratchet wrench having a collar-actuated reverse mechanism.

FIG. 9 shows an alternate embodiment of a ratchet wrench in accordance with the present invention. The illustrated ratchet wrench includes many components that are similar to the components illustrated in FIGS. 1-8 and are given the same numbers as described for FIGS. 1-8 and will not be described in detail regarding FIG. 9. The components that differ from the embodiment of FIGS. 1-8 are numbered in the 300 series.

The embodiment of FIG. 9 includes a right angle gear 306 positioned on the second end 22 of the ratchet housing 18. The right angle gear 306 includes projections 308 that extend radially outward (with respect to axis A). A collar 342 includes channels 310 that slidingly receive the projections 308. The right angle gear 306 is substantially positioned within the collar 342 and is fixed for rotation with the collar 342 about the axis A due to the engagement of the projections 308 in the channels 310. In the illustrated embodiment, five projections 308 and channels 310 are shown, but other quantities and arrangements of projections and channels are possible and are considered to be within the scope of the present invention.

The right angle gear 306 further includes pairs of intermittent axially extending (with respect to axis A) teeth 312 that selectively engage the teeth 90 to rotate the second gear 88 and thereby rotate first gear 84, gear portion 80 and pawl 96.

Rotation of the right angle gear 306 about first axis A causes the ratchet wrench shown in FIG. 9 to switch between clockwise and counterclockwise rotation about the second axis B, which is substantially perpendicular to the first axis A. Other quantities and spacing of the teeth 312 are possible and are considered within the scope of the present invention. The quantity and spacing of teeth can be determined based upon the amount of travel needed to switch the direction selector between its two positions, the gear ratio of the spur gears and the geometry of the drive body. In some embodiments, two or more teeth are included in each set of teeth. In another embodiment, the right angle gear includes continuous teeth extending toward gear 88. In this embodiment, one of the gears 80, 84 and 88 can include intermittent teeth, if desired, such that rotation of the right angle gear selectively causes rotation of the direction selector 76 to change the operation direction of the ratchet wrench.

The ratchet wrench of FIG. 9 further includes a detent holder 314 positioned within the collar 342. The detent holder 314 includes a first protrusion 315 that retains a detent ball 316 and a detent spring 318 against the collar 342. The detent holder 314 includes a second protrusion 317 positioned across from the first protrusion 315. The collar 342 includes a pair of channels 319 that matingly receive the respective protrusions 315, 317 to fix the detent holder 314 to the collar 342 for rotation with the collar 342. A plurality of detents 321 are defined in the ratchet housing second end 22 to receive the detent ball 316 to resist movement of the collar 342 from a first position or a second position. A detent mechanism includes the detent holder 314, the ball 316, the spring 318, and detents 321. Other shapes and sizes of detents 321, detent ball 316 and detent spring 318 can be utilized. In some embodiments, at least one of the detents 321, detent ball 316 and detent spring 318 is omitted.

The embodiment illustrated in FIG. 9 includes a spring washer 323 positioned between the right angle gear 306 and the detent holder 314 to bias the right angle gear 306 into engagement with the gear 88. A washer 325 is included between the drive body 62 and the ratchet housing first end 20. The washer 325 can be a friction washer and/or a wear washer. The washer 325 functions as a friction washer to resist movement of the drive body 62 with respect to the ratchet housing 18 and as a wear washer to permit movement of the drive body 62 with respect to the ratchet housing 18 during operation of the ratchet wrench 10. Other similar washer(s) can be included in the embodiment of FIGS. 1-8 without departing from the scope of the present invention.

Various features and advantages of the invention are set forth in the following claims.

What is claimed is:

1. A ratchet wrench comprising:

an elongate handle having a first end and second free end, the handle extending substantially along a first axis;

a ratchet housing having a first free end and a second end coupled to the handle first end, the ratchet housing extending substantially along the first axis, the ratchet housing having a first portion and a second portion spaced from the first portion, such that the first and second portions extend substantially along the first axis;

a drive body coupled to the ratchet housing for rotation relative to the ratchet housing about a second axis, substantially perpendicular to the first axis, the drive body extending between and coupled to the first and second portions of the ratchet housing;

a yoke coupled to the ratchet housing for oscillating movement with respect to the ratchet housing, the yoke substantially encircling the drive body;

a direction selector coupled to the drive body and extending along the second axis, the direction selector rotatable about the second axis with respect to the drive body between a first position, in which the yoke is rotatable clockwise with respect to the drive body and the yoke is coupled to the drive body for counterclockwise rotation with the drive body about the second axis, and a second position, in which the yoke is rotatable counterclockwise with respect to the drive body and the yoke is coupled to the drive body for clockwise rotation with the drive body about the second axis;

a direction actuator coupled to the direction selector for rotation about the first axis to move the direction selector about the second axis between the first and second positions; and at least one gear coupled to the direction selector for rotation about a third axis substantially parallel to the second axis to transfer rotation from the direction actuator to the direction selector.

2. The ratchet wrench of claim 1, further comprising a fluid inlet operable to receive a flow of fluid to rotate the drive body.

3. The ratchet wrench of claim 1, wherein the direction actuator comprises a collar at least partially encircling the ratchet housing proximate the elongate handle.

4. The ratchet wrench of claim 1, wherein the direction actuator is positioned proximate the handle first end, such that the direction actuator is rotatable by a first hand of an operator while the operator is grasping the elongate handle with said first hand.

5. The ratchet wrench of claim 1, wherein the at least one gear includes first and second gears, wherein the first and second gears are rotatable about axes substantially parallel to the second axis, wherein the first and second gears work together to rotate the direction selector between the first and second positions upon rotation of the direction actuator.

6. The ratchet wrench of claim 5, further comprising a substantially planar plate coupled to the first portion of the ratchet housing, the first and second gears are positioned between the ratchet housing and the plate.

7. The ratchet wrench of claim 1, wherein the direction actuator includes a collar at least partially encircling the ratchet housing second end and graspable by a user and a right angle gear at least partially encircling the ratchet housing second end and positioned between the collar and the ratchet housing second end, wherein the right angle gear selectively engages the at least one gear, such that the right angle gear is operable to rotate the direction selector between the first and second positions.

8. The ratchet wrench of claim 7, wherein the at least one gear includes a first gear and a second gear, such that the first gear is in meshing engagement with the direction selector and the second gear is in meshing engagement with the first gear, wherein the right angle gear selectively engages the second gear to rotate the second gear, and thus the first gear and the direction selector in response to rotation of the right angle gear.

9. The ratchet wrench of claim 7, wherein the at least one gear has teeth wherein the right angle gear includes intermittent teeth that are operable to engage the teeth of the at least one gear to rotate the direction selector.

10. A ratchet wrench comprising:

an elongate handle having a first end and second free end, the handle extending substantially along a first axis;

a ratchet housing having a first free end and a second end coupled to the handle first end, the ratchet housing extending substantially along the first axis, the ratchet housing having a first portion extending substantially parallel to the first axis and defining a first aperture, and a second portion spaced from the first portion and extending substantially parallel to the first axis and defining a second aperture;

a drive body coupled to the ratchet housing proximate the ratchet housing first end, the drive body operable to rotate relative to the ratchet housing about a second axis, substantially perpendicular to the first axis, the drive body including a body portion extending between the first and second portions, and a projection extending through the second aperture;

a yoke coupled to the ratchet housing for movement with respect to the ratchet housing, the yoke positioned to selectively engage the drive body;

a direction selector coupled to the drive body, extending along the second axis and extending into the first aperture, the direction selector rotatable relative to the drive body about the second axis between a first position, in which the yoke is rotatable clockwise with respect to the drive body and the yoke is coupled to the drive body for counterclockwise rotation with the drive body about the second axis, and a second position, in which the yoke is rotatable counterclockwise with respect to the drive body and the yoke is coupled to the drive body for clockwise rotation with the drive body about the second axis; and a direction actuator coupled to the ratchet housing for rotation relative to the ratchet housing about the first axis, the direction actuator spaced from the drive body along the first axis, and coupled to the direction selector to rotate the direction selector about the second axis between the first and second positions;

wherein the direction actuator includes a collar at least partially encircling the ratchet housing second end and graspable by a user and a right angle gear at least partially encircling the ratchet housing second end and positioned between the collar and the ratchet housing second end, such that the right angle gear is operable to rotate the direction selector between the first and second positions.

11. The ratchet wrench of claim 10, wherein the collar at least partially encircling the ratchet housing proximate the elongate handle.

12. The ratchet wrench of claim 10, wherein the direction actuator is positioned proximate the handle first end, such that the direction actuator is rotatable by a first hand of an operator while the operator is grasping the elongate handle with said first hand.

13. The ratchet wrench of claim 10, further comprising at least one gear selectively engaging the right angle gear for rotation about a third axis substantially parallel to the second axis to transfer rotation from the direction actuator to the direction selector.

14. The ratchet wrench of claim 10, further comprising first and second gears, wherein the first and second gears are rotatable about axes substantially parallel to the second axis, wherein the second gear selectively engages the right angle gear, wherein the first and second gears work together to rotate the direction selector between the first and second positions upon rotation of the direction actuator.

15. The ratchet wrench of claim 14, further comprising a substantially planar plate coupled to the first portion of the ratchet housing, the first and second gears are positioned between the ratchet housing and the plate.

16. The ratchet wrench of claim 10, further comprising a first gear and second gear, such that the first gear is in meshing engagement with the direction selector and the second gear is in meshing engagement with the first gear, wherein the right angle gear selectively engages the second gear to rotate the second gear, and thus the first gear and the direction selector in response to rotation of the right angle gear.

17. The ratchet wrench of claim 10, further comprising at least one gear having teeth wherein the right angle gear includes intermittent teeth that are operable to engage the teeth of the at least one gear to rotate the direction selector.

18. A ratchet wrench comprising:

an elongate handle extending substantially along a first axis;

a ratchet housing coupled to the handle, the ratchet housing extending substantially along the first axis, the ratchet housing having a first portion extending substantially parallel to the first axis and defining a first aperture, and a second portion spaced from the first portion and extending substantially parallel to the first axis and defining a second aperture;

a drive body coupled to the ratchet housing for rotation relative to the ratchet housing about a second axis, substantially perpendicular to the first axis, the drive body including a body portion defining a third aperture extending along the second axis between the first and second apertures, and a protruding portion extending through the second aperture;

a yoke coupled to the ratchet housing for movement with respect to the ratchet housing, the yoke including a yoke aperture that receives a portion of the drive body therethrough;

a direction selector having a shaft portion and a gear portion, the shaft portion extending through the first aperture and into the third aperture of the drive body, the gear portion having at least one tooth and positioned outside the first aperture and spaced from the second portion, the direction selector rotatable between a first position, in which the yoke is rotatable clockwise with respect to the drive body and the yoke is coupled to the drive body for counterclockwise rotation with the drive body about the second axis, and a second position, in which the yoke is rotatable counterclockwise with respect to the drive body and the yoke is coupled to the drive body for clockwise rotation with the drive body about the second axis;

a direction actuator assembly including a right angle gear having intermittent teeth and a collar coupled to the ratchet housing, the right angle gear and the collar are rotatable with respect to the ratchet housing about the first axis; and at least one spur gear having a plurality of teeth and positioned to engage the at least one tooth of the gear portion and the intermittent teeth of the right angle gear, such that rotation of the direction actuator assembly about the first axis rotates the direction selector about the second axis to move the direction selector between the first and second positions.

* * * * *